US009261318B2

(12) United States Patent
Wood, Jr. et al.

(10) Patent No.: US 9,261,318 B2
(45) Date of Patent: Feb. 16, 2016

(54) FIREARM ACCESSORY MOUNTING ASSEMBLY

(71) Applicants: Thomas G Wood, Jr., Lillington, NC (US); Timothy H Jernigan, Lillington, NC (US)

(72) Inventors: Thomas G Wood, Jr., Lillington, NC (US); Timothy H Jernigan, Lillington, NC (US)

( * ) Notice: Subject to any disclaimer, the term of this patent is extended or adjusted under 35 U.S.C. 154(b) by 0 days.

(21) Appl. No.: 14/521,566

(22) Filed: Oct. 23, 2014

(65) Prior Publication Data

US 2015/0135575 A1 May 21, 2015

Related U.S. Application Data

(60) Provisional application No. 61/906,963, filed on Nov. 21, 2013.

(51) Int. Cl.
*F41A 21/00* (2006.01)
*F41A 21/32* (2006.01)

(52) U.S. Cl.
CPC ..... *F41A 21/325* (2013.01)

(58) Field of Classification Search
CPC ..... F41A 21/325; F41A 21/48; Y10T 403/56
USPC ..... 89/14.05–16
See application file for complete search history.

(56) References Cited

U.S. PATENT DOCUMENTS

| | | | | | |
|---|---|---|---|---|---|
| 487,487 | A * | 12/1892 | Mason | 42/75.02 |
| 2,736,117 | A * | 2/1956 | Clarkson et al. | 42/75.02 |
| 5,283,689 | A * | 2/1994 | Carlough | 359/427 |
| 5,433,133 | A * | 7/1995 | La France | 89/14.2 |
| 5,483,362 | A * | 1/1996 | Tai et al. | 359/1 |
| 6,604,315 | B1 * | 8/2003 | Smith et al. | 42/112 |
| 7,076,904 | B1 * | 7/2006 | Rustick | 42/75.02 |
| 8,006,395 | B2 * | 8/2011 | Kingsbury | 33/265 |
| 8,739,450 | B2 * | 6/2014 | Piontek | 42/77 |
| 9,057,576 | B2 * | 6/2015 | Barrett et al. | |
| 2003/0019352 | A1 * | 1/2003 | Mika | 89/14.05 |
| 2005/0057808 | A1 * | 3/2005 | Houde-Walter | 359/566 |
| 2005/0241210 | A1 * | 11/2005 | Karcher et al. | 42/119 |
| 2007/0044364 | A1 * | 3/2007 | Sammut et al. | 42/122 |
| 2009/0051989 | A1 * | 2/2009 | Dobschal et al. | 359/15 |
| 2009/0217565 | A1 * | 9/2009 | Ford | 42/114 |
| 2013/0000172 | A1 * | 1/2013 | Ford | 42/70.01 |
| 2014/0373424 | A1 * | 12/2014 | Silvers et al. | 42/122 |

* cited by examiner

*Primary Examiner* — Samir Abdosh
(74) *Attorney, Agent, or Firm* — MacCord Mason PLLC

(57) ABSTRACT

An assembly is described for use in attaching accessories to a firearm having a barrel with a threaded distal end. The assembly includes a coupler with opposed, inwardly curved side plates that together form a cylindrical bore for receiving the firearm barrel attachable behind the threaded distal end, the side plates have integrally joined upper ends and lower ends that are moveable toward each other to clamp the coupler to the barrel, the coupler including a retractable pin having an extended position and a retracted position; and an adapter having a rear end with a threaded bore for receiving the barrel threaded end, and a front end with a threaded projection for attachment to a firearm accessory, the adapter including a groove to receive the retractable pin when the retractable pin is in the extended position.

19 Claims, 3 Drawing Sheets

FIREARM ACCESSORY MOUNTING ASSEMBLY

This application claims the benefit of the filing date of U.S. Provisional Patent Application Ser. No. 61/906,963, filed Nov. 21, 2013, which is incorporated herein in its entirety.

FIELD OF THE INVENTION

The present invention relates generally to an assembly for attaching accessories such as flash suppressors to the muzzle end of a firearm barrel, and in particular to an assembly that enables quick changing of accessories by simply screwing adapter attached accessories to a gun barrel mounted coupler.

BACKGROUND OF THE INVENTION

Some firearms such as AR15s and M16s have barrels with threaded front ends for use in attaching muzzle accessories. The term "accessories" also sometimes referred to as "attachments", as used herein includes, but is not limited to, brakes, flash suppressors, flash hider brake combos, silencers, breeching tips, medieval devices, golf ball launchers, and the like. These accessories include threaded bores extending into their rear ends that are sized to screw onto the threaded end of the barrel. While the invention will be described with particular reference to AR15s and M16s, it will be understood that the invention is also applicable to other rifles and handguns that have threaded barrel ends for attachment of muzzle accessories.

When accessories are screwed directly to the barrel, changing or removal of accessories, particularly when in the field, is difficult and time consuming. Changing often requiring a vise or other means to secure the firearm and a wrench to unscrew an accessory from the barrel and screw on another accessory. What is needed is a means enabling quick attachment and removal of accessories on gun barrels having threaded front ends, preferably without the need for tools to hold the firearm or turn the accessory relative to the firearm.

SUMMARY OF THE INVENTION

The present invention addresses this need by providing an accessory attachment assembly comprised of a coupler attachable to a gun barrel behind the barrel threaded end, and an adapter having a front end configured for attachment to an accessory and a rear end configured for quick release to the coupler.

More specifically, the coupler is comprised of opposed inwardly curved side plates that together form a cylindrical bore having an inner diameter slightly larger than the outer diameter of the barrel to which the coupler is to be attached. The upper ends of the plates are integrally joined, e.g., by machining as a single piece, while the lower ends of the plates are unattached and spaced from each other. The coupler also includes a clamping means that can be used to move the lower ends of the plates toward each other and against the barrel. For example, a bolt rotatable with an Allen wrench can extend through threaded bores in the spaced ends, with the screw being tightened to pull the ends toward each other.

In order for the coupler to be suitable for barrels of different diameters, the coupler can also include sleeves or shims that are inserted into the coupler bore against the curved inner laces of the plates. Thus, the coupler bore will be sized to fit snugly over the barrel of the largest diameter, while sleeves can be used to size the bore to fit snugly with barrels of smaller diameters.

The coupler also includes a first latching component that cooperates with a second latching component on an adapter to releasably secure an adapter to the coupler. For example, the first latching component can be a retractable pin having an extended position in which the pin engages a recess or groove in the adapter, and a retracted position in which the pin disengages from contact with the adapter.

The adapter includes a bore at its rear end sized to receive the threaded end of the barrel, and a threaded projection at its front end sized for insertion into a threaded bore at the rear end of an accessory. Generally, the threaded projection replicates the diameter, length and thread pitch of the threaded end of the barrel so that accessories manufactured for attachment to the barrel end can be attached to the front projection of the adapter. A bullet bore corresponding in diameter to the barrel bore extends through the projection.

As noted, the adapter includes a second latching component to cooperate with the first latching component on the coupler. Where the first latching component is a retractable pin, the second latching component can be a recess to receive the pin. For purposes of quick release without tools, the recess can be in the form of a groove on the outer surface, preferably the top, of the adapter, with the groove having a diameter less than the diameter of the pin so that part of the pin projects above the groove when inserted. With this configuration, the user can simply detach the pin from engagement with the adapter by pushing the pin rearwardly with a fingertip, fingernail, bullet tip, key, knife, etc.

The invention also contemplates an adapter blank that can be quickly attached to the coupler to protect the threads on the front of the barrel. The adapter blank has the same rear configuration as described above, but does not include the threaded projection. The front end of the adapter may be flared around the bore. This adapter can be used when firing the weapon, or for storage purposes. Due to the ease of removal of the accessories, pointed accessories, such as medieval, pronged or blade style accessories, can simply be removed during storage or transport of the firearm preventing damage to storage cases or bags, or surrounding objects.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
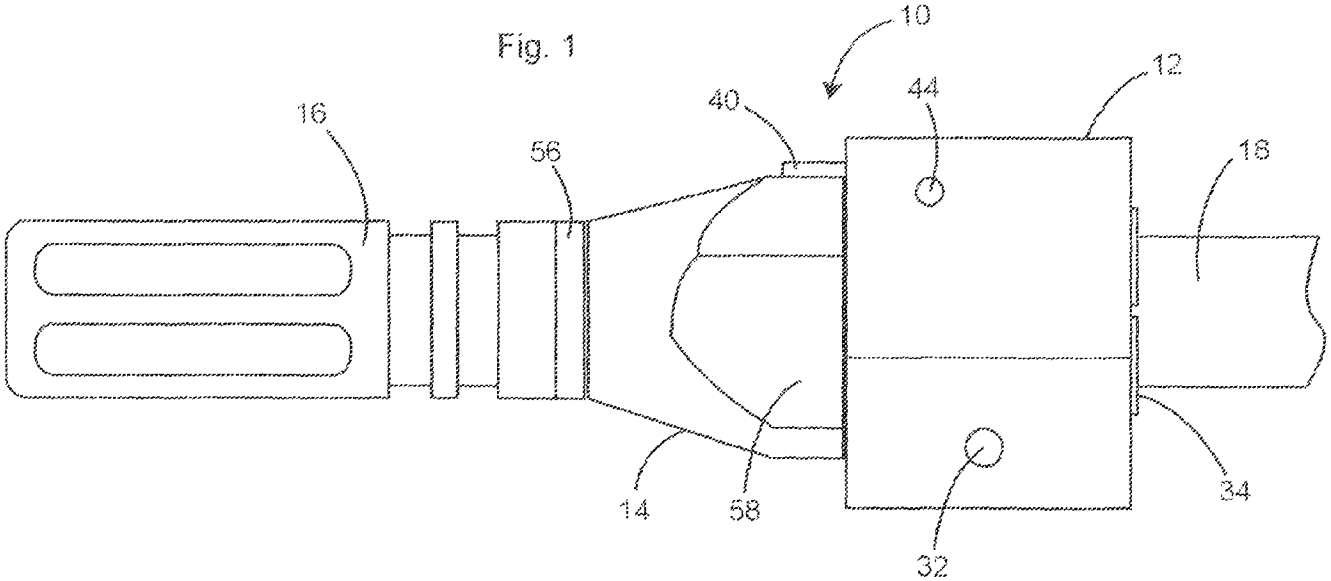
FIG. 1 is a side view of the quick-change assembly showing an accessory mounted to the end of a firearm barrel.
Figure 2:
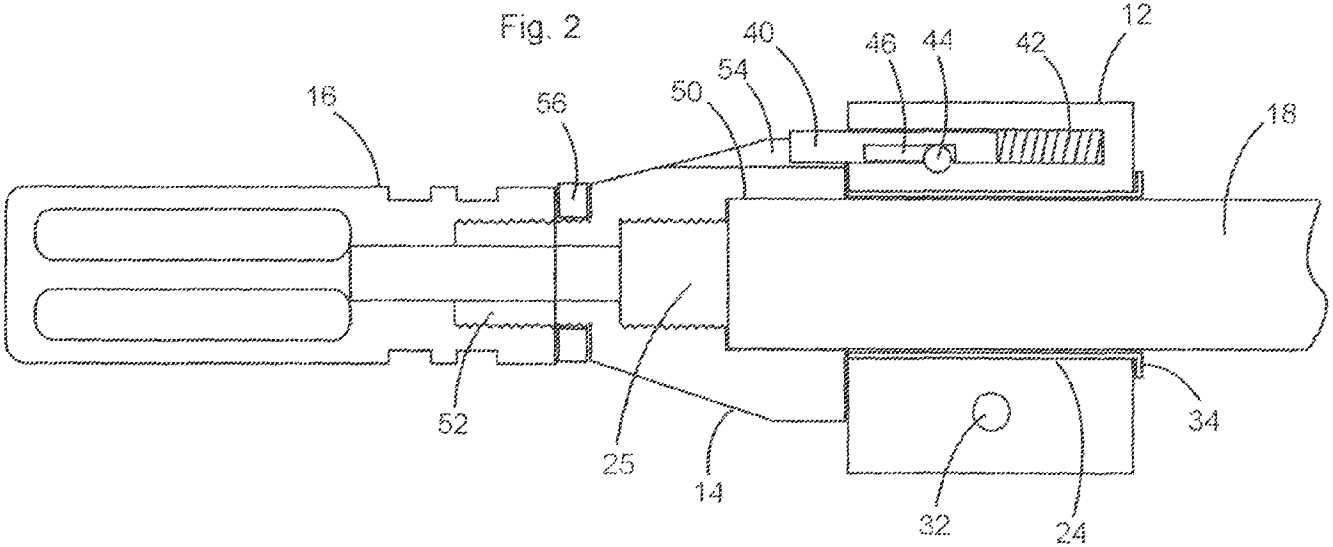
FIG. 2 is a sectional side view of the quick-change assembly showing an accessory mounted to the end of a firearm barrel.
Figure 3:
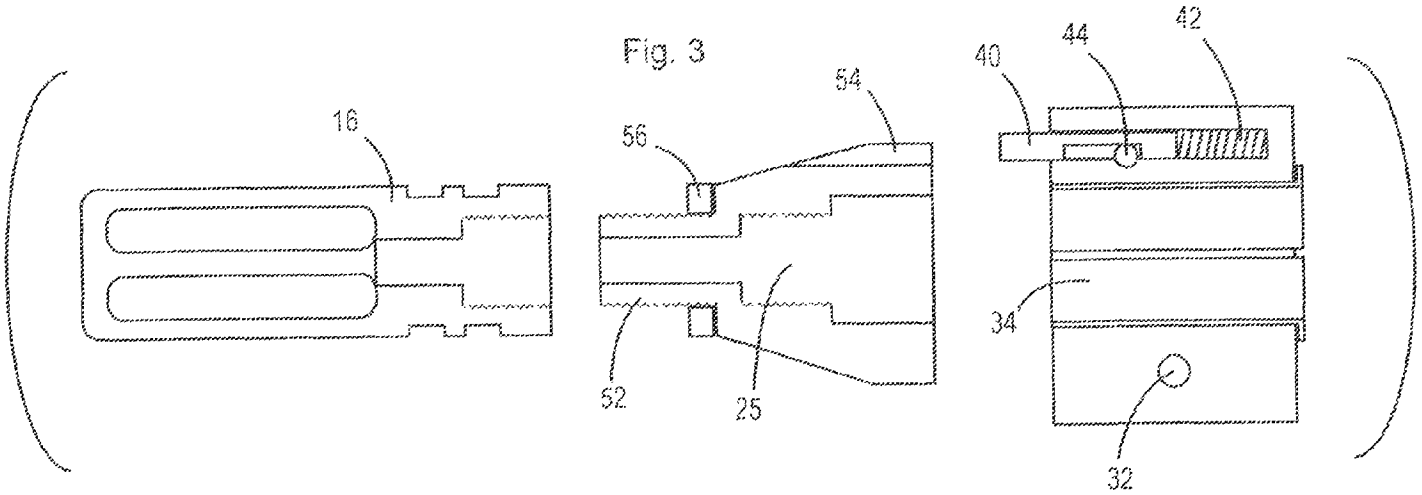
FIG. 3 is an exploded sectional side view of the quick-change assembly and accessory.
Figure 6:
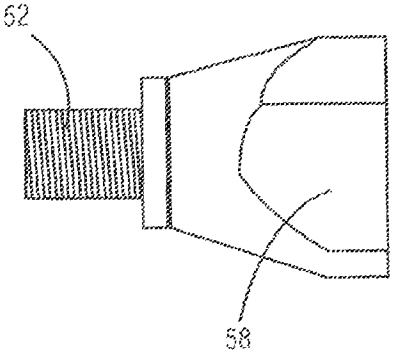
FIG. 6 is a side view of the adapter.
Figure 7:
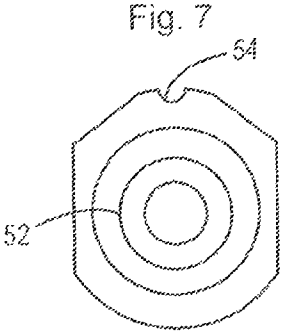
FIG. 7 is a front view of the adapter.
Figure 4:
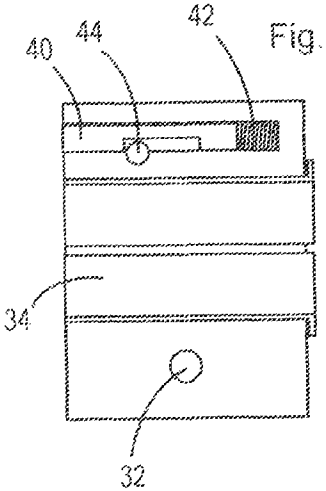
FIG. 4 is a sectional side view of the coupler with the latching pin in the retracted position.
Figure 5:
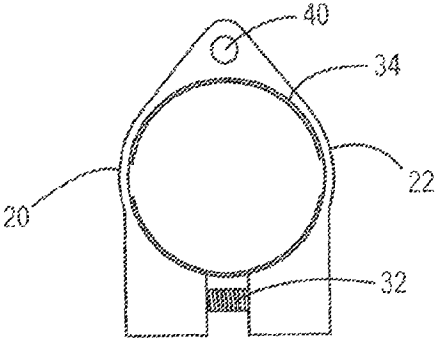
FIG. 5 is a front view of the coupler with inserted sleeve.
Figure 9:
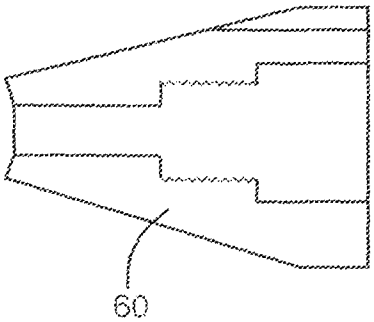
FIG. 9 is a sectional side view of an adapter blank.
Figure 8:
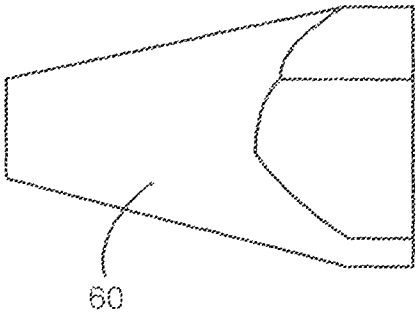
FIG. 8 is a side view of an adapter blank.

As best illustrated, particularly in FIGS. 1-3, the quick-connect assembly, generally 10, is comprised of a coupler 12 and an adapter 14. As shown, adapter 14 is used to attach an accessory 16 to a firearms barrel 18.

Coupler 12 includes side plates 20 and 22 that have mirror image curved inner faces together forming a circular bore 24 to receive barrel 18 which has a threaded end 25. The upper ends of plates 20 and 22 are integrally formed, while lower ends 26 and 30 of plates 20 and 22, respectively, are joined by threaded rod 32, which can be tightened to draw plates 20 and 22 toward each other, thereby pressing plates 20 and 22 against barrel 18. When using assembly 10 with a smaller diameter barrel as illustrated, two-section sleeve 34 can be positioned inside bore 24.

Coupler 12 also includes a retractable latching pin 40 that is urged to an extended position extending from the front of coupler 12 by spring 42. Pressing rearwardly on the front of pin 40 forces pin 40 rearwardly to compress spring 42. Forward and rearward movement of pin 40 is limited by keeper pin 44 riding within slot 46.

Adapter 14 includes a barrel bore 50 extending inwardly from the rear of adapter 14, a threaded accessory connector projection 52 extending from the front of adapter 14, and a groove 54 to slidably receive pin 40. A washer 56 can also be included to orient accessory 16 relative to adapter 14. Bore 50 is sized to receive the front end of barrel 18 and includes internal threads for joining the threaded end of barrel 18.

Projection 52 replicates the threaded end of barrel 18 in diameter and thread count so that accessories manufactured to attach to barrel 18 can be screwed onto projection 52. Groove 54 is preferably positioned at the top of adapter 14 and is aligned with pin 40 so that pin 40 extends into groove 54 when adapter 14 is attached to coupler 12. Groove 54 is open at the top with pin 40 projecting above groove 54 so that the user can push pin 40 rearwardly out of contact with adapter 14 with a finger or other object.

Adapter 14 also includes parallel flats 58 on opposite sides sized to fit in an armorer's tool, a standard wrench or a vise to aid in removal, attachment, torqueing or indexing of accessories.

In operation, the user first positions coupler 12 around barrel 18 behind threaded end 25. Plates 20 and 22 are then clamped onto barrel 18 by tightening threaded rod 32. When attaching coupler 12 to a smaller barrel, sleeve 34 is positioned between barrel 18 and coupler 12 before tightening rod 32. Pin 40 is positioned at the top of barrel 18.

Accessory 16 is screwed onto projection 52 and oriented to the desired position relative to groove 54. Normally, a plurality of different accessories will be attached to different adapters and carried by the user into the field. One of adapters 14 is screwed onto the end of barrel 18 by inserting threaded barrel end 25 into bore 50. Pin 40 is held in the retracted position while adapter 14 is screwed onto barrel 18. When adapter 14 abuts coupler 12 and pin 40 is aligned with groove 54, pin 40 is released to slide into groove 54 preventing rotation of adapter 12 relative to coupler 14.

When the user desires to change the accessory, pin 40 is retracted, e.g., by pushing pin 40 backward with a finger or other object until pin 40 is no longer in groove 54. Adapter 14 and its attached accessory 16 are then unscrewed from coupler 12 and another accessory and adapter can be attached. Thus, an accessory can be quickly and easily removed or replaced in the field without the use of tools.

In order to protect threaded end 25 of barrel 18, blank adapter 60 can be screwed onto the end of barrel 18. Adapter 60 is secured to coupler 12 in the same manner as described above using pin 40. Adapter 60 can include a flared bore.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An assembly for use in attaching accessories to a firearm having a barrel with a threaded distal end comprising:

a) a coupler attachable around the firearm barrel behind the threaded distal end and having a retractable pin; and b) an adapter having a rear end with a threaded bore for receiving the barrel threaded end and a recess for receiving said retractable pin, said adapter being releasibly attachable to said coupler.

2. The assembly of claim 1, wherein said adapter includes a threaded projection at its distal end for attachment to a firearm accessory.

3. The assembly of claim 1, wherein said coupler has opposed inwardly curved side plates that together form a cylindrical bore for receiving the firearm barrel.

4. The assembly or claim 1, wherein said coupler further includes an adapter sleeve.

5. An assembly for use in attaching accessories to a firearm having a barrel with a threaded distal end comprising:

a) a coupler with opposed, inwardly curved side plates that together form a cylindrical bore for receiving the firearm barrel attachable behind the threaded distal end; and b) an adapter having a rear end with a threaded bore for receiving the barrel threaded end, and front end with a projection for attachment to a firearm accessory, said adapter being releasibly attachable to said coupler.

6. The assembly of claim 5, wherein said coupler side plates have upper ends that are attached and lower ends that are moveable toward each other to clamp said coupler to said barrel.

7. The assembly of claim 5, wherein said coupler further includes a sleeve insertable inside said coupler side plates.

8. The assembly of claim 5, wherein said coupler includes a retractable pin and said adapter includes a recess for receiving said pin.

9. The assembly of claim 5, wherein said projection is a threaded projection that replicates the diameter, length and thread pitch of the barrel threaded end so that accessories threadable onto said barrel end are also threadable onto said projection.

10. The assembly of claim 5, further including an adapter blank having a rear end with a threaded bore for receiving the barrel threaded end, and front end without a threaded projection.

11. The assembly of claim 5, wherein said coupler includes parallel tool flats on opposite sides.

12. An assembly for use in attaching accessories to a firearm having a barrel with a threaded distal end comprising:

a) a coupler with opposed, inwardly curved side plates that together form a cylindrical bore for receiving the firearm barrel attachable behind the threaded distal end, said side plates have integrally joined upper ends and lower ends that are moveable toward each other to clamp said coupler to said barrel, said coupler including a retractable pin having an extended position and a retracted position;

and an adapter having a rear end with a threaded bore for receiving the barrel threaded end, and a front end with a threaded projection for attachment to a firearm accessory, said adapter including a groove to receive said retractable pin when said retractable pin is in the extended position.

13. The assembly of claim 12, further including a threaded clamping rod extending through the lower ends of said side plates.

14. The assembly of claim 12, wherein said pin projects above said groove when in the extended position.

15. The assembly of claim 12, wherein said coupler further includes a sleeve insertable inside said side plates.

16. The assembly of claim 12, wherein the threaded projection replicates the diameter, length and thread pitch of the barrel threaded end so that accessories threadable onto said barrel end are also threadable onto said projection.

17. The assembly of claim 12, further including an adapter blank having a rear end with a threaded bore for receiving the barrel threaded end, and front end without a threaded projection.

18. The assembly of claim 12, wherein said coupler includes parallel tool flats on opposite sides.

19. The assembly of claim 12, further including a spring urging said pin to its extended position and a keeper limiting forward movement of said pin.

* * * * *